US008322184B2

(12) United States Patent
Kariya

(10) Patent No.: US 8,322,184 B2
(45) Date of Patent: Dec. 4, 2012

(54) METHOD OF PRODUCING METALLIC SHELL FOR SPARK PLUG

(75) Inventor: Mitsunari Kariya, Kasugai (JP)

(73) Assignee: NGK Spark Plug Co., Ltd., Aichi (JP)

( * ) Notice: Subject to any disclaimer, the term of this patent is extended or adjusted under 35 U.S.C. 154(b) by 357 days.

(21) Appl. No.: 12/715,885

(22) Filed: Mar. 2, 2010

(65) Prior Publication Data

US 2010/0223973 A1 Sep. 9, 2010

(30) Foreign Application Priority Data

Mar. 3, 2009 (JP) ..... 2009-048970

(51) Int. Cl.
*B21K 21/08* (2006.01)

(52) U.S. Cl. ..... 72/356; 72/355.6; 72/359

(58) Field of Classification Search ..... 72/334, 72/347, 354, 355.6, 356, 358, 359, 377, 378
See application file for complete search history.

(56) References Cited

U.S. PATENT DOCUMENTS

| | | | | |
|---|---|---|---|---|
| 3,186,209 | A * | 6/1965 | Friedman | 72/334 |
| 4,352,283 | A * | 10/1982 | Bailey | 72/377 |
| 4,882,925 | A * | 11/1989 | Ichie et al. | 72/356 |
| 5,088,311 | A | 2/1992 | Inoue | |
| 6,357,274 | B1 | 3/2002 | Tanaka et al. | |
| 6,792,786 | B2 * | 9/2004 | Tanaka | 72/348 |
| 7,013,696 | B2 * | 3/2006 | Ando et al. | 72/355.6 |
| 7,172,483 | B2 * | 2/2007 | Ando et al. | 72/356 |

FOREIGN PATENT DOCUMENTS

| | | | |
|---|---|---|---|
| JP | 60-216944 | A | 10/1985 |
| JP | 3-90243 | A | 4/1991 |
| JP | 07-016693 | A | 1/1995 |
| JP | 2829596 | B2 | 11/1998 |
| JP | 2001-121240 | A | 5/2001 |

* cited by examiner

*Primary Examiner* — David B Jones
(74) *Attorney, Agent, or Firm* — Sughrue Mion, PLLC

(57) ABSTRACT

A method of producing a metallic shell for a spark plug, including steps of preparing a first intermediate article by using a first die including a first large diameter cavity larger in diameter than a metal blank, a first small diameter cavity smaller in diameter than the metal blank, a curved tapered cavity between the first large diameter cavity and the first small diameter cavity, and an oil drain cavity between the first large diameter cavity and the tapered cavity and substantially same in diameter as the metal blank, wherein the metal blank is inserted in the first large diameter cavity and extruded to allow a configuration of the metal blank to conform to the first large diameter cavity, the oil drain cavity, the tapered cavity and the first small diameter cavity while being pressed by a punch, and preparing a second intermediate article by using a second die.

7 Claims, 6 Drawing Sheets

METHOD OF PRODUCING METALLIC SHELL FOR SPARK PLUG

BACKGROUND OF THE INVENTION

The present invention relates to a method of producing a metallic shell for a spark plug of an engine.

Japanese Patent Application Unexamined Publication No. H7-16693 shows a spark plug including a metallic shell. Referring now to FIG. 4 and FIG. 5, the spark plug and the metallic shell are explained. As shown in FIG. 4, a spark plug 1 includes a generally tubular metallic shell 3 having a through hole 2 that extends through the metallic shell 3 in an axial direction of the metallic shell 3. An insulator 4 is mounted into the through hole 2 of the metallic shell 3. An electrode mounting hole 5 extends through the insulator 4 in a direction of a central axis of the insulator 4. A center electrode 6 is disposed in a tip end-side portion of the electrode mounting hole 5. A ground electrode 7 is arranged such that one end portion thereof is fixedly attached to an axial tip end face of the metallic shell 3 and the other end portion thereof is opposed to a tip end face of the center electrode 6.

The metallic shell 3 includes a screw shaft portion 10 to be screwed into a spark plug mounting tap hole 9 of an engine (i.e., a cylinder head) 8, and a flange-shaped stop portion 11 which is disposed on a rear side (i.e., one axial end side) of the screw shaft portion 10 (that is, on an upper side thereof as shown in FIG. 4 and FIG. 5) and larger in outer diameter than the spark plug mounting tap hole 9. The metallic shell 3 further includes a tool engagement portion 12 that is disposed on a rear side (i.e., one axial end side) of a stop portion 11 and engageable with a tool. The tool engagement portion 12 is formed into a shape, for instance, a hexagonal prism shape, suitable for engagement with the tool such as a wrench. A caulking portion 13 which holds the insulator 4 to the metallic shell 3 is disposed at a rear end of the tool engagement portion 12. The caulking portion 13 is formed in such a manner that a tubular portion extending in an axial direction of the tool engagement portion 12 as shown in FIG. 5, is rounded by caulking as shown in FIG. 4. A grooved portion 14 is disposed between the stop portion 11 and the tool engagement portion 12.

The above conventional art discloses a method of producing the metallic shell 3 of the spark plug 1 having the above-described structure. The method is now explained by referring to FIGS. 3A1-3F and FIGS. 6A1-6C. As shown in FIG. 3A1 and FIG. 6A1, a cylindrical wire rod made of a suitable material, for instance, a low carbon steel, is cut to a predetermined length to thereby prepare a metal blank M. Next, the metal blank M is subjected to upsetting by using a cold forging machine (not shown) and thereby formed into a bullet-shaped workpiece N having a round chamfered portion 15 as shown in FIG. 3A2 and FIG. 6A2. The round chamfered portion 15 extends over an entire circumference of a tip end of the workpiece N.

Next, a first die 180 shown in FIGS. 6B1 and 6B2 is prepared. The first die 180 includes a first large diameter cavity 180*a* larger in diameter than the workpiece N, a first small diameter cavity 180*b* smaller in diameter than the workpiece N, and a tapered cavity 180*c* between the first large diameter cavity 180*a* and the first small diameter cavity 180*b*. The first large diameter cavity 180*a* is configured to form a portion of the workpiece N which is later formed into the stop portion 11 of the completed metallic shell 3. The first small diameter cavity 180*b* is configured to form a portion of the workpiece N which is later formed into screw shaft portion 10 of the completed metallic shell 3. The tapered cavity 180*c* is connected to a terminal end of the first large diameter cavity 180*a* and an initial end of the first small diameter cavity 180*b*.

Subsequently, as shown in FIG. 6B1, the workpiece N is inserted in the first large diameter cavity 180*a* of the first die 180. As shown in FIG. 6B2, the workpiece N is extruded so as to conform to the first large diameter cavity 180*a*, the tapered cavity 180*c* and the first small diameter cavity 180*b*, while being pressed by punch 190. The workpiece N is thus formed into a first intermediate article N1 including a large diameter portion Na and a tapered portion Nc which are formed into a base of the stop portion 11 of the completed metallic shell 3, and a small diameter portion Nb that is formed into a base of the screw shaft portion 10 of the completed metallic shell 3. The first intermediate article N1 shown in FIG. 3B is thus obtained.

Next, as shown in FIG. 6C, a second die 200 is prepared. The second die 200 has a stepped cavity including a second large diameter cavity 200*a* larger in diameter than the large diameter portion Na of the first intermediate article N1, and a second small diameter cavity 200*b* into which the small diameter portion Nb of the first intermediate article N1 is insertable. The second large diameter cavity 200*a* and the second small diameter cavity 200*b* are continuously arranged to form the stepped cavity.

Subsequently, the first intermediate article N1 having the second large diameter portion Na, the tapered portion Nc and the small diameter portion Nb is inserted in the stepped cavity of the second die 200 which includes the second large diameter cavity 200*a* and the second small diameter cavity 200*b*. The first intermediate article N1 is then pressed by a punch 210 and extruded to thereby form a second intermediate article N2. Upon the extrusion, a hole Nd later serving as the through hole 2 of the completed metallic shell 3 is formed by the punch 210, and at the same time, the large diameter portion Na and the tapered portion Nc are expanded in a radial direction thereof so as to conform to the second large diameter cavity 200*a*. The second intermediate article N2 shown in FIG. 3C is thus obtained.

Next, the second intermediate article N2 is subjected to extrusion with a cold forging machine and thereby formed into a third intermediate article N3 shown in FIG. 3D. The third intermediate article N3 is then subjected to punching with a cold forging machine and thereby formed into a fourth intermediate article N4 shown in FIG. 3E.

Next, the fourth intermediate article N4 is subjected to extrusion with a cold forging machine and thereby formed into a fifth intermediate article N5 shown in FIG. 3F. The fifth intermediate article N5 is then subjected to rolling to form a male-thread portion on an outer circumferential surface of the small diameter portion Nb which corresponds to the screw shaft portion 10 of the completed metallic shell 3. The fifth intermediate article N5 is then subjected to machining or cutting to form a grooved portion that corresponds to the grooved portion 14 between the tool engagement portion 12 and the stop portion 11 of the completed metallic shell 3. Thus, the completed metallic shell 3 shown in FIG. 4 is obtained.

SUMMARY OF THE INVENTION

As explained above, in the method of producing the metallic shell 3 according to the above conventional art, the cut metal blank M is subjected to upsetting and thereby formed into the bullet-shaped workpiece N, and then the workpiece N is formed into the first intermediate article N1 by using the first die 180. In order to achieve enhanced productivity, the inventor of the present invention has tried to produce the metallic shell 3 as shown in FIGS. 7A-7C. In the method shown in FIGS. 7A-7C, the step of forming the cut metal blank M into the bullet-shaped workpiece N as shown in FIG. 3A2 is omitted from the steps shown in FIGS. 3A1-3F, and the cut metal blank M is instead directly extruded with the first die 180. As a result, it was found that the through hole 2 of the metallic shell obtained by this method was deteriorated in eccentric accuracy. It was concluded that the deterioration in eccentric accuracy was caused due to the following reason.

That is, the first large diameter cavity 180*a* of the first die 180 is slightly larger in diameter than the metal blank M in order to facilitate insertion of the metal blank M. Therefore, there is generated a slight clearance, for instance, a clearance of about 0.2 mm, between the first die 180 and the metal blank M inserted in the first large diameter cavity 180*a*. As a result, metal working oil tends to enter into the clearance.

On the other hand, occasionally, a cross section of the cut metal blank M is deformed due to stress that is generated upon cutting, so that a recess 16 is caused in a local area of the cut metal blank M as shown in FIG. 7A. In such a case, the metal working oil received in the recess 16 may be trapped in a part of the tapered cavity 180*c* of the first die 180. The first intermediate article M1 made from the cut metal blank M with the recess 16 has a concaved portion 17 in a local area of a tapered portion Mc which is caused due to a trace of the metal working oil trapped.

Meanwhile, in the conventional method, there is also present a possibility of trapping the metal working oil in the tapered cavity 180*c* of the first die 180 upon producing the metallic shell. However, in the conventional method as shown in FIG. 6A2, the workpiece N has the chamfered portion 15 that is formed along the entire circumference of the tip end portion of the cut metal blank M, so that the metal working oil is allowed to spread over an entire circumferential surface of the tapered cavity 180*c* without being retained in a part of the tapered cavity 180*c*, even though the metal working oil is trapped in the tapered cavity 180*c*. Accordingly, a concaved portion will not be generated in a local area of the tapered portion Nc of the first intermediate article N1.

In a case where the first intermediate article M1 having the concaved portion 17 in the local area of the tapered portion Mc as shown in FIG. 7B2 is inserted in the second die 200 and pressed by the punch 210 as shown in FIG. 7C, the punch 210 will be displaced or escaped in a direction indicated by arrow X. This leads to deterioration in eccentric accuracy of a hole Md of a large diameter portion Ma as shown in FIG. 7C and the through hole 2 of the completed metallic shell 3.

The present invention has been made in view of the above problems. It is an object of the present invention to provide a method of producing a metallic shell without deteriorating eccentric accuracy of a through hole of the metallic shell, in which a cut metal workpiece can be directly subjected to extruding with a first die.

In one aspect of the present invention, there is provided a method of producing a metallic shell for a spark plug from a cylindrical metal blank cut to a predetermined length, the metallic shell including a screw shaft portion to be screwed into a spark plug mounting tap hole of an engine, a stop portion that is disposed on one axial end side of the screw shaft portion and larger in diameter than the spark plug mounting tap hole, and a through hole extending through the metallic shell in an axial direction of the metallic shell, the method comprising the steps of:

preparing a first intermediate article including a large diameter portion and a tapered portion which are to be later formed into the stop portion of the metallic shell and a small diameter portion which is to be later formed into the screw shaft portion of the metallic shell, by using a first die including a first large diameter cavity which is larger in diameter than the metal blank and configured to form a portion of the metal blank which is to be later formed into the stop portion of the metallic shell, a first small diameter cavity which is smaller in diameter than the metal blank and configured to form a portion of the metal blank which is to be later formed into the screw shaft portion of the metallic shell, a curved tapered cavity between the first large diameter cavity and the first small diameter cavity which has one axial end connected with an axial end of the first small diameter cavity in an axially opposed relation thereto, and an oil drain cavity between the first large diameter cavity and the curved tapered cavity which is substantially same in diameter as the metal blank, wherein the metal blank is inserted in the first large diameter cavity and extruded to allow a configuration of the metal blank to conform to the first large diameter cavity, the oil drain cavity, the curved tapered cavity and the first small diameter cavity while being pressed by a punch; and preparing a second intermediate article by using a second die including a second large diameter cavity larger in diameter than the large diameter portion of the first intermediate article and a second small diameter cavity into which the small diameter portion of the first intermediate article is insertable, the second large diameter cavity and the second small diameter cavity being continuously connected with each other to form a stepped cavity, wherein the large diameter portion and the tapered portion of the first intermediate article are inserted in the second large diameter cavity of the second die and the small diameter portion of the first intermediate article is inserted in the second small diameter cavity of the second die, and then the first intermediate article is pressed by a punch such that a hole later serving as the through hole of the metallic shell is formed, and at the same time, the large diameter portion and the tapered portion of the first intermediate article are expanded in a radial direction thereof and allowed to conform to the second large diameter cavity.

In a still further aspect of the present invention, there is provided a die for producing a metallic shell for a spark plug from a cylindrical metal blank cut to a predetermined length, the metallic shell including a screw shaft portion to be screwed into a spark plug mounting tap hole of an engine, a stop portion that is disposed on one axial end side of the screw shaft portion and larger in diameter than the spark plug mounting tap hole, and a through hole extending through the metallic shell in an axial direction of the metallic shell, the die comprising:

a large diameter cavity larger in diameter than the metal blank and configured to form a portion of the metal blank which is to be later formed into the stop portion of the metallic shell;

a small diameter cavity smaller in diameter than the metal blank and configured to form a portion of the metal blank which is to be later formed into the screw shaft portion of the metallic shell;

a curved tapered cavity disposed between the large diameter cavity and the small diameter cavity, the curved tapered cavity having one axial end connected with an axial end of the small diameter cavity in an axially opposed relation thereto; and an oil drain cavity disposed between the large diameter cavity and the curved tapered cavity, the oil drain cavity being substantially same in diameter as the metal blank so as to scrape a metal working oil attached to an outer circumferential surface of the metal blank.

BRIEF DESCRIPTION OF THE DRAWINGS

FIG. 1*b*1 and FIG. 1*b*2 are sectional views showing steps of forming the metal blank into a first intermediate article by using a first die in the method according to the embodiment of the present invention.

FIG. 3A1 shows a metal blank usable in a conventional method of producing a metallic shell, in which a half part of the metal blank is shown in a sectional view taken along a central axis thereof.

FIG. 3A2 shows a workpiece to be used in the conventional method, in which a half part of the workpiece is shown in a sectional view taken along a central axis thereof.

FIG. 6A1 is a sectional view of a metal blank usable in the conventional method.

FIG. 6A2 is a sectional view of a workpiece to be used in the conventional method of producing a metallic shell.

FIG. 6B1 and FIG. 6B2 are sectional views showing steps of forming the workpiece into a first intermediate article by using a first die in the conventional method.

FIG. 7B1 and FIG. 7B2 are sectional views showing steps of directly forming the metal blank into a first intermediate article by using a first die in the conventional method.

DETAILED DESCRIPTION OF THE INVENTION

Referring to FIG. 1*a* to FIG. 1*c* and FIG. 2*a* to FIG. 2*f*, a method of producing a metallic shell for a spark plug will be explained hereinafter. The spark plug has the same construction as described above by referring to FIG. 4 and FIG. 5, and therefore, detailed explanations therefor are omitted.

Figures 1A, 1C:
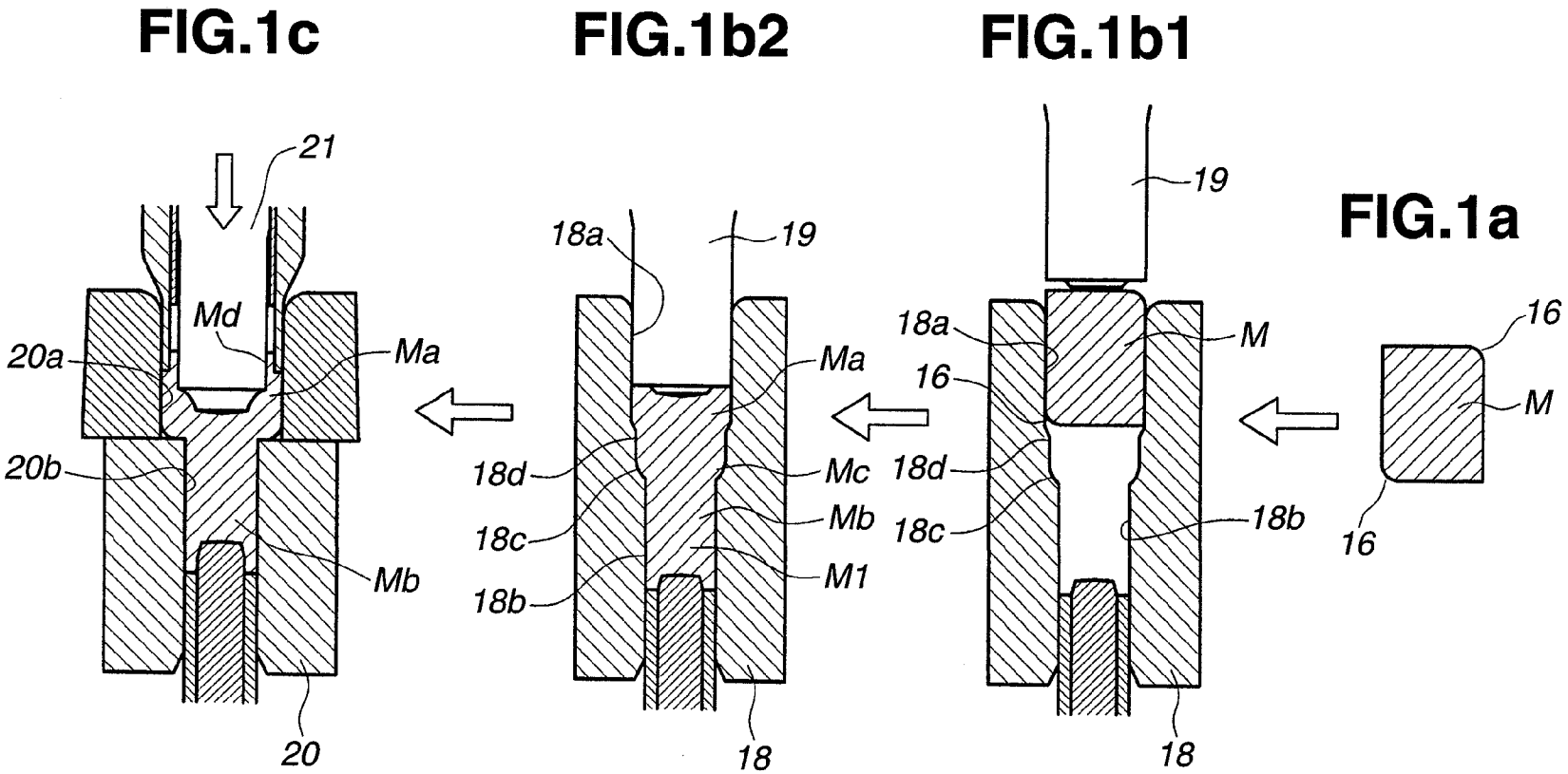
FIG. 1*a* is a sectional view of a metal blank usable in a method of producing a metallic shell, according to an embodiment of the present invention.
FIG. 1*c* is a sectional view showing a step of forming the first intermediate article into a second intermediate article by using a second die in the method according to the embodiment of the present invention.
Figures 2A, 2B, 2C, 2D, 2E, 2F, 3B, 3C, 3D, 3E, 3F:
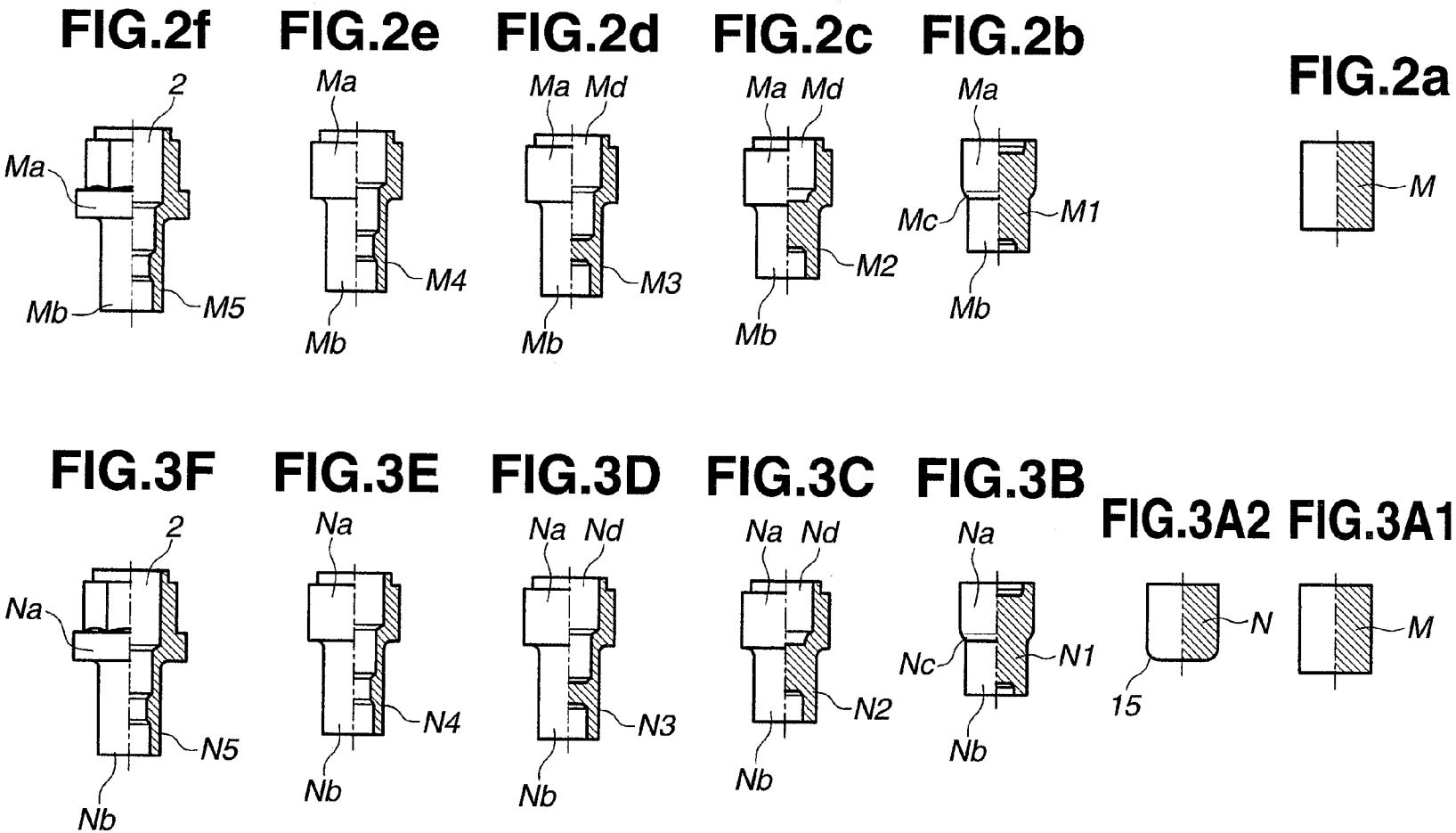
FIG. 2*a* shows a metal blank usable in the method according to the embodiment of the present invention, in which a half part of the metal blank is shown in a sectional view taken along a central axis thereof.
FIG. 2*b* to FIG. 2*f* show intermediate articles which are formed in the successive steps of the production method according to the embodiment of the present invention.
FIG. 3B to FIG. 3F show intermediate articles which are formed in the successive steps of the conventional method.

As shown in FIG. 1*a* and FIG. 2*a*, a metal blank M is prepared by cutting a cylindrical wire rod made of a suitable material, for instance, a low carbon steel, to a predetermined length. In FIG. 1*a*, a round chamfer-shaped portion of the metal blank M indicates a locally recessed portion 16 which is generated on an outer circumferential surface of the metal blank M due to a stress upon cutting the wire rod.

Figure 5:
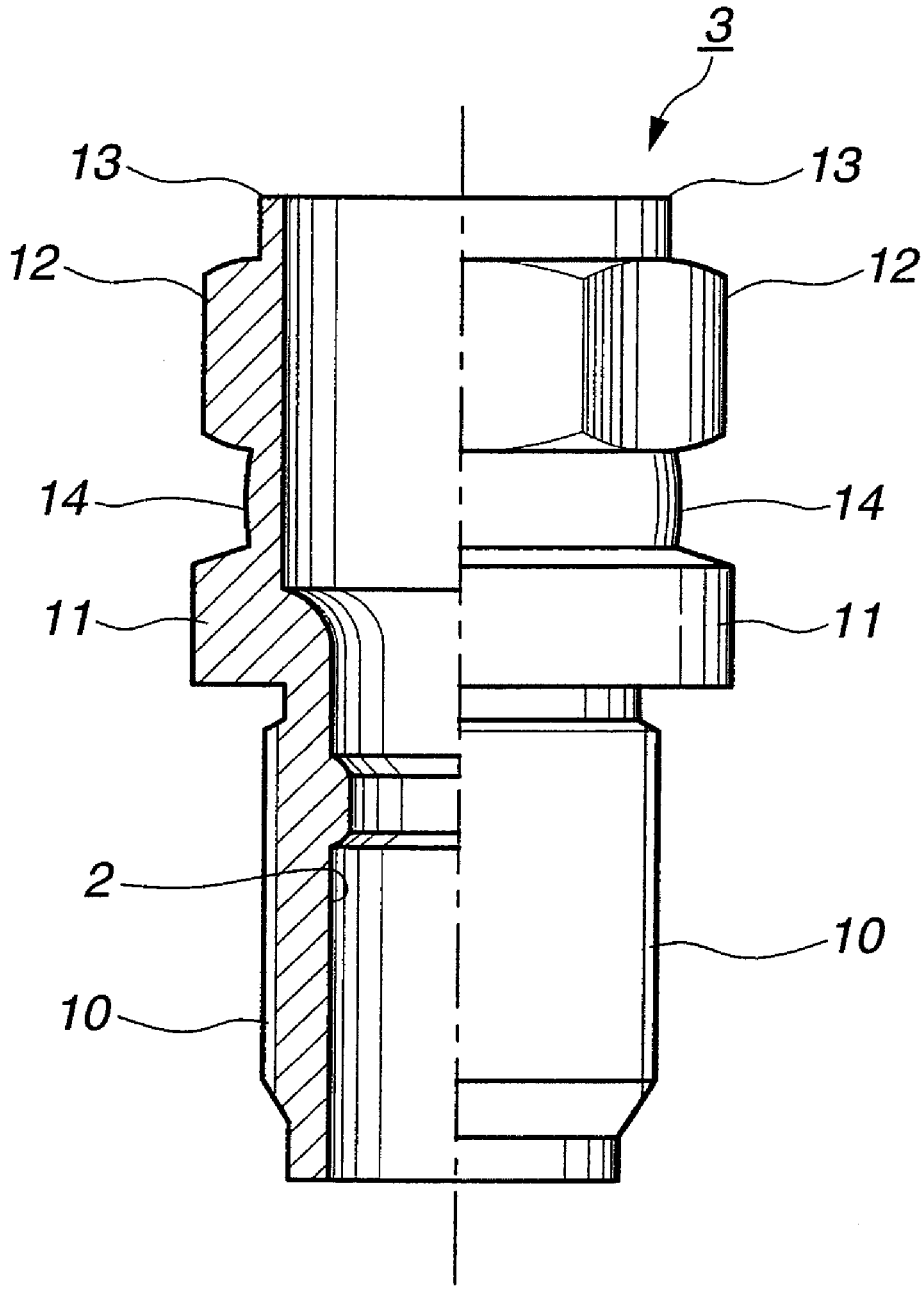
FIG. 5 shows the metallic shell, in which a half part of the metallic shell is shown in a sectional view taken along a central axis thereof.

Next, as shown in FIGS. 1*b*1-1*b*2, a first die 18 having a specific shape is prepared. The first die 18 includes a first large diameter cavity 18*a*, a first small diameter cavity 18*b*, a tapered cavity 18*c* disposed between the first large diameter cavity 18*a* and the first small diameter cavity 18*b*, and an oil drain cavity 18*d* disposed between the first large diameter cavity 18*a* and the tapered cavity 18*c*. The first large diameter cavity 18*a*, the first small diameter cavity 18*b*, the tapered cavity 18*c* and the oil drain cavity 18*d* are concentrically arranged along a central axis of the first die 18. The first large diameter cavity 18*a* is larger in diameter than the metal blank M and configured to form a portion of the metal blank M which is to be later formed into the stop portion 11 of the metallic shell 3 as shown in FIG. 5. The first small diameter cavity 18*b* is disposed on one axial end side of the first large diameter cavity 18*a* and smaller in diameter than the metal blank M. The first small diameter cavity 18*b* is configured to form a portion of the metal blank M which is to be later formed into the screw shaft portion 10 of the metallic shell 3 as shown in FIG. 5. The tapered cavity 18*c* has a curved shape in cross section taken along the central axis of the first die 18 as shown in FIGS. 1*b*1-1*b*2 and has one axial end (i.e., a lower end) connected with an axial end (i.e., an upper end) of the first small diameter cavity 18*b* in axially opposed relation thereto. The oil drain cavity 18*d* has substantially the same diameter as that of the metal blank M (for instance, in the range of from the same diameter as that of the metal blank M to a diameter capable of interference fit of the metal blank M thereinto under the cold condition).

Subsequently, as shown in FIG. 1*b*1, the metal blank M is inserted in the first large diameter cavity 18*a* of the first die 18. As shown in FIG. 1*b*2, the metal blank M is then extruded to allow a configuration of the metal blank M to conform to the first large diameter cavity 18*a*, the oil drain cavity 18*d*, the tapered cavity 18*c* and the first small diameter cavity 18*b* of the first die 18, while being pressed by a punch 19. Thus, a first intermediate article M1 as shown in FIG. 2*b* is prepared, which includes a large diameter portion Ma and a tapered portion Mc which are to be formed into the stop portion 11 of the metallic shell 3 as a completed product, and a small diameter portion Mb which is to be formed into the screw shaft portion 10 of the completed metallic shell 3.

When the metal blank M is inserted in the first large diameter cavity 18*a* of the first die 18 and then extruded into the first small diameter cavity 18*b*, the metal blank M is pushed through the oil drain cavity 18*d* having substantially the same diameter as that of the metal blank M. At this time, the metal working oil attached to the outer circumferential surface of the metal blank M and the locally recessed portion 16 is scraped away. Therefore, the metal working oil can be prevented from being trapped in the tapered cavity 18*c* so that the first intermediate article M1 is formed with no concaved portion 17 which is generated in the local area of the tapered portion Mc due to the trapped metal working oil as shown in FIG. 7B2.

Figure 6C:
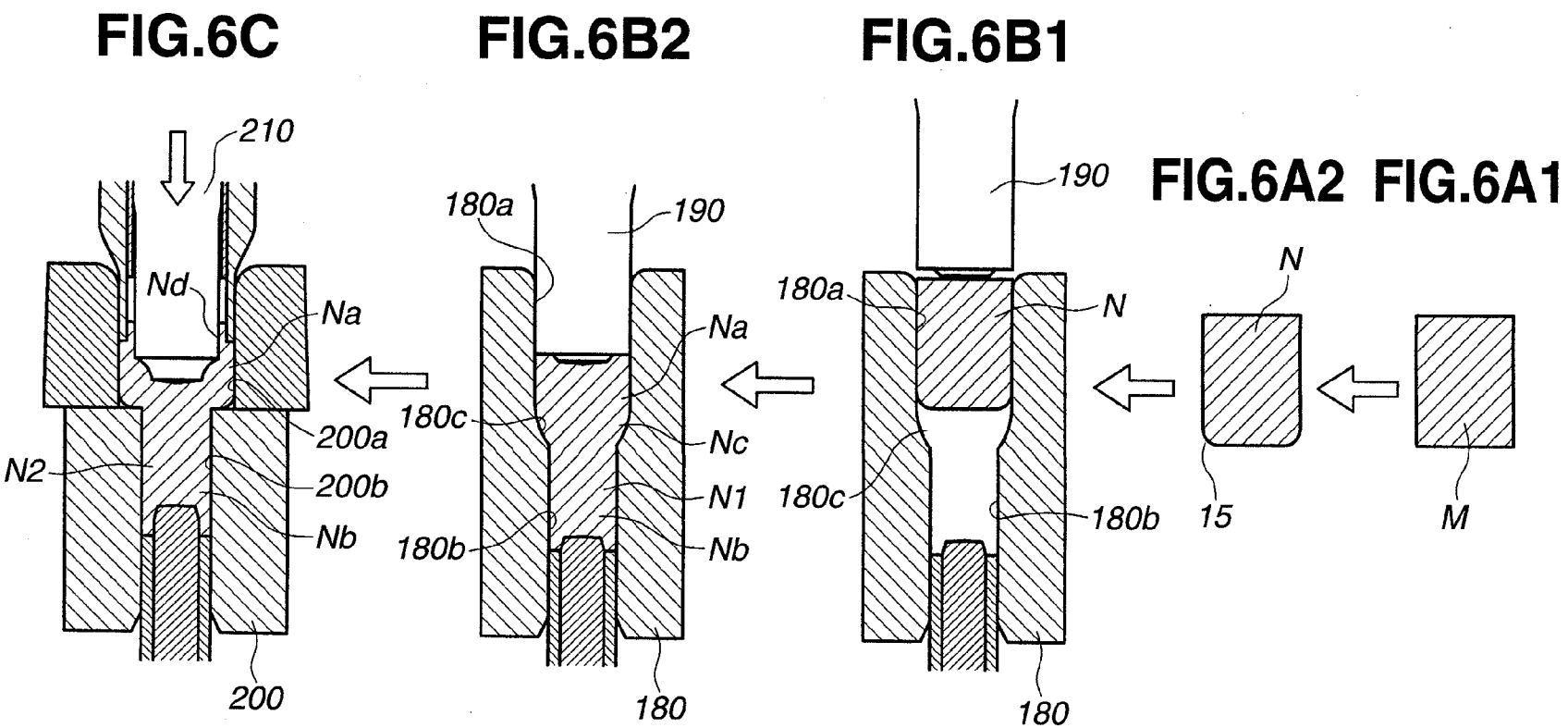
FIG. 6C is a sectional view showing a step of forming the first intermediate article into a second intermediate article by using a second die in the conventional method.

Next, as shown in FIG. 1*c*, a second die 20 is prepared. The second die 20 includes a second large diameter cavity 20*a* larger in diameter than the large diameter portion Ma of the first intermediate article M1, and a second small diameter cavity 20*b* into which the small diameter portion Mb of the first intermediate article M1 is insertable. The second large diameter cavity 20*a* and the second small diameter cavity 20*b* are continuously connected to form a stepped cavity. The second die 20 is the same as the second die 200 used in the conventional method as shown in FIG. 6C.

Subsequently, as shown in FIG. 1*c*, the large diameter portion Ma and the tapered portion Mc of the first intermediate article M1 are inserted in the second large diameter cavity 20*a* of the second die 20, and the small diameter portion Mb of the first intermediate article M1 is inserted in the second small diameter cavity 20*b* of the second die 20. The first intermediate article M1 is then pressed by a punch 21 and extruded to thereby prepare a second intermediate article M2 as shown in FIG. 2*c*. Upon the extrusion, a hole Md which later serves as the through hole 2 of the completed metallic shell 3 is formed by the punch 21, and at the same time, the large diameter portion Ma and the tapered portion Mc are expanded in a radial direction thereof and allowed to conform to the second large diameter cavity 20*a*.

Figures 7A, 7C:
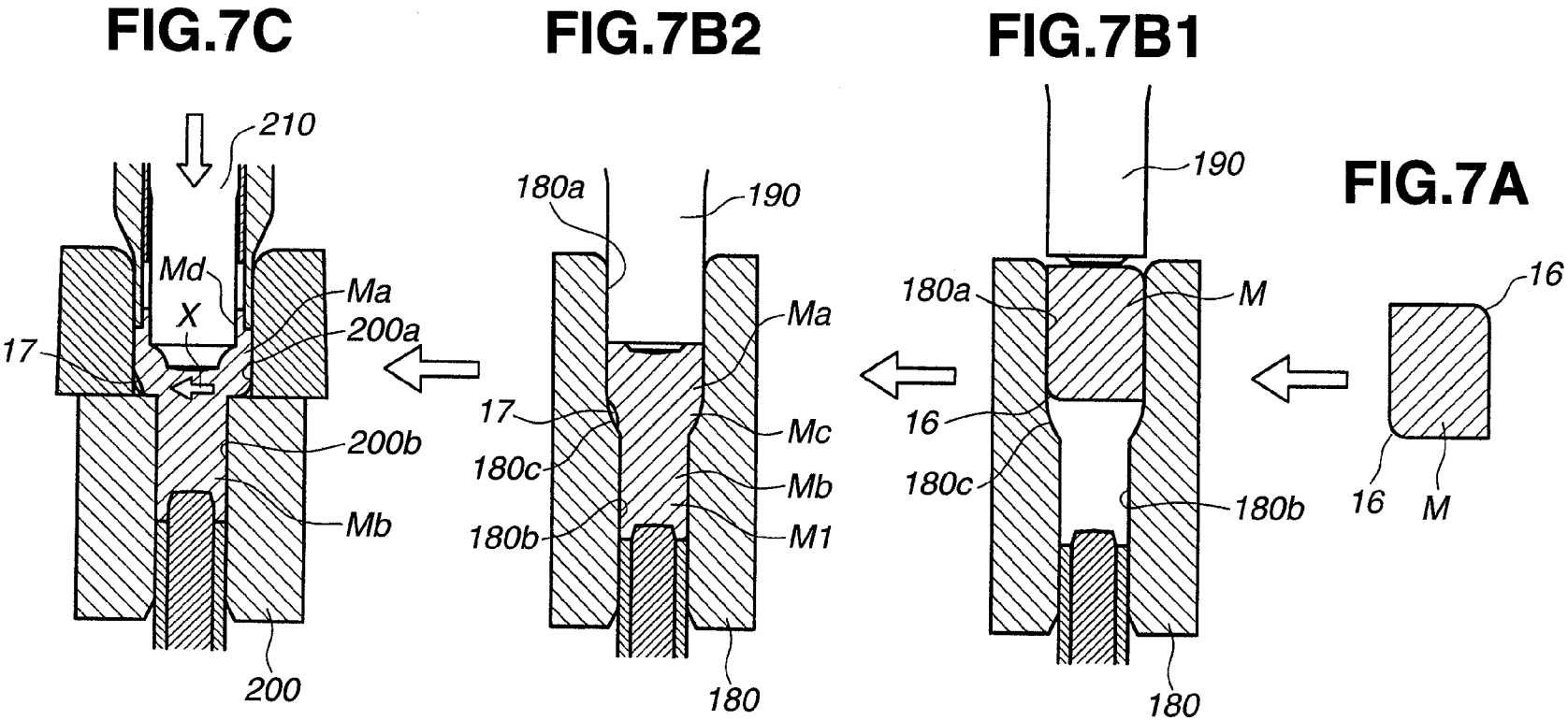
FIG. 7A is a sectional view of a metal blank usable in a comparative example of the method according to the embodiment.
FIG. 7C is a sectional view showing a step of forming the first intermediate article into a second intermediate article by using a second die in the conventional method.

In the method according to the embodiment of the present invention, there hardly occurs the concaved portion 17 shown in FIG. 7B2 which is generated in the local area of the tapered portion Mc. Accordingly, the step of forming the hole Md by using the second die 20 and the punch 21 can be performed with high accuracy.

Next, the second intermediate article M2 is subjected to extrusion with a cold forging machine to thereby prepare a third intermediate article M3 shown in FIG. 2*d*. Subsequently, the third intermediate article M3 is subjected to punching with a cold forging machine to thereby prepare a fourth intermediate article M4 shown in FIG. 2*e*.

Figure 4:
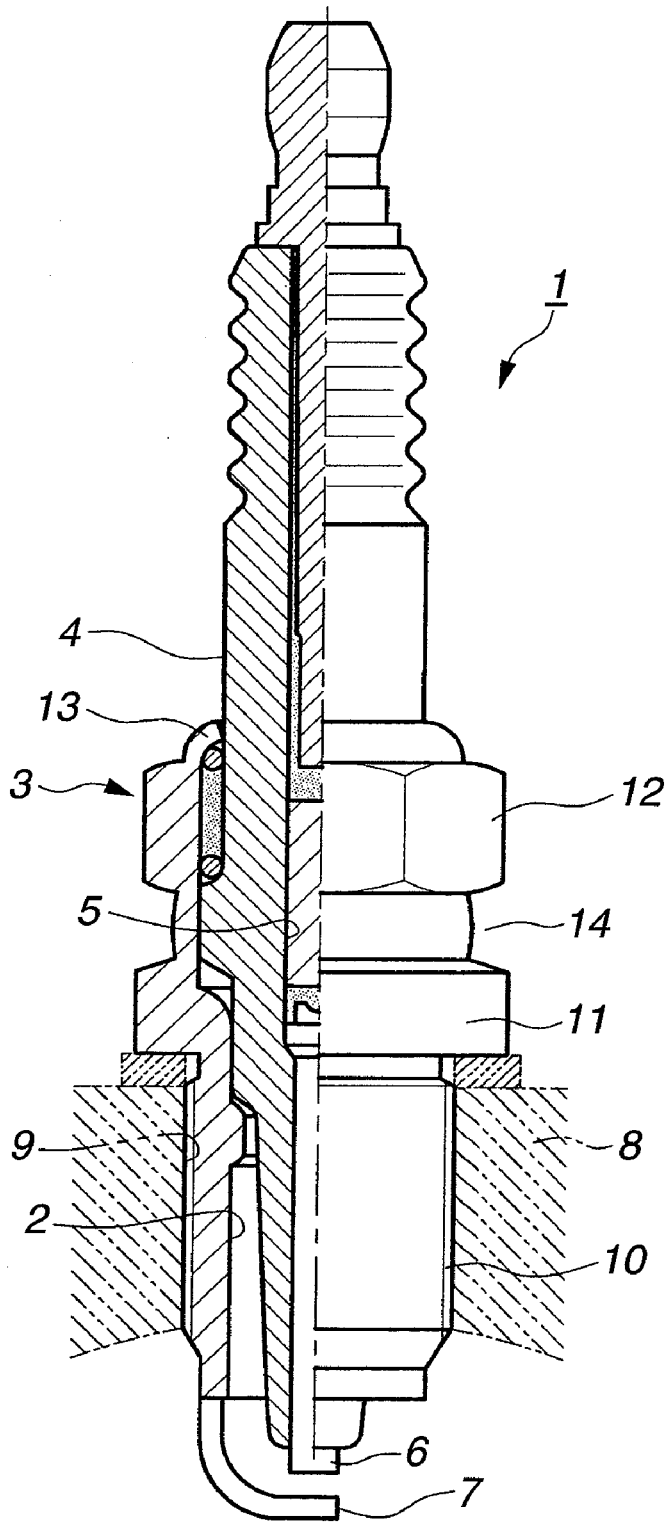
FIG. 4 shows a spark plug including a metallic shell, in which a half part of the spark plug is shown in a sectional view taken along a central axis thereof.

Next, the fourth intermediate article M4 is subjected to extrusion with a cold forging machine to thereby prepare a fifth intermediate article M5 shown in FIG. 2*f*. Subsequently, the fifth intermediate article M5 is subjected to rolling to form a male-thread portion on an outer circumferential surface of the small diameter portion Mb which corresponds to the screw shaft portion 10 of the completed metallic shell 3. The fifth intermediate article M5 is then subjected to machining or cutting to form a grooved portion on the large diameter portion Ma which corresponds to the grooved portion 14 disposed between the tool engagement portion 12 and the stop portion 11 of the completed metallic shell 3. Thus, the completed metallic shell 3 shown in FIG. 4 is obtained.

The present invention is not limited to the above-described embodiment in which the metallic shell 3 is completed via the first intermediate article M1 through the fifth intermediate article M5. For instance, after the second intermediate article M2 is formed from the first intermediate article M1, any optional method and number of steps can be used to complete the metallic shell 3.

Further, the respective terms "first die", "second die", "first intermediate article", "second intermediate article" and the like are not necessarily consistent with the order of the steps of the method.

This application is based on prior Japanese Patent Application No. 2009-048970 filed on Mar. 3, 2009. The entire contents of the Japanese Patent Application No. 2009-048970 are hereby incorporated by reference.

Although the invention has been described above by reference to a certain embodiment of the invention, the invention is not limited to the embodiment described above. Modifications and variations of the embodiment described above will occur to those skilled in the art in light of the above teachings. The scope of the invention is defined with reference to the following claims.

What is claimed is:

1. A method of producing a metallic shell for a spark plug from a cylindrical metal blank cut to a predetermined length, the metallic shell including a screw shaft portion to be screwed into a spark plug mounting tap hole of an engine, a stop portion that is disposed on one axial end side of the screw shaft portion and larger in diameter than the spark plug mounting tap hole, and a through hole extending through the metallic shell in an axial direction of the metallic shell, the method comprising the steps of:

preparing a first intermediate article including a large diameter portion and a tapered portion which are to be later formed into the stop portion of the metallic shell and a small diameter portion which is to be later formed into the screw shaft portion of the metallic shell, by using a first die including a first large diameter cavity which is larger in diameter than the metal blank and configured to form a portion of the metal blank which is to be later formed into the stop portion of the metallic shell, a first small diameter cavity which is smaller in diameter than the metal blank and configured to form a portion of the metal blank which is to be later formed into the screw shaft portion of the metallic shell, a curved tapered cavity between the first large diameter cavity and the first small diameter cavity which has one axial end connected with an axial end of the first small diameter cavity in an axially opposed relation thereto, and an oil drain cavity between the first large diameter cavity and the curved tapered cavity which is substantially same in diameter as the metal blank, wherein the metal blank is inserted in the first large diameter cavity and extruded to allow a configuration of the metal blank to conform to the first large diameter cavity, the oil drain cavity, the curved tapered cavity and the first small diameter cavity while being pressed by a punch; and preparing a second intermediate article by using a second die including a second large diameter cavity larger in diameter than the large diameter portion of the first intermediate article and a second small diameter cavity into which the small diameter portion of the first intermediate article is insertable, the second large diameter cavity and the second small diameter cavity being continuously connected with each other to form a stepped cavity, wherein the large diameter portion and the tapered portion of the first intermediate article are inserted in the second large diameter cavity of the second die and the small diameter portion of the first intermediate article is inserted in the second small diameter cavity of the second die, and then the first intermediate article is pressed by a punch such that a hole later serving as the through hole of the metallic shell is formed, and at the same time, the large diameter portion and the tapered portion of the first intermediate article are expanded in a radial direction thereof and allowed to conform to the second large diameter cavity, said method further comprising after the second intermediate article preparing step, a step of preparing a third intermediate article by subjecting the second intermediate article to extrusion.

2. The method as claimed in claim 1, further comprising after the third intermediate article preparing step, a step of preparing a fourth intermediate article by subjecting the third intermediate article to punching.

3. The method as claimed in claim 2, further comprising after the fourth intermediate article preparing step, a step of preparing a fifth intermediate article by subjecting the fourth intermediate article to extrusion.

4. The method as claimed in claim 3, further comprising after the fifth intermediate article preparing step, a step of subjecting a small diameter portion of the fifth intermediate article to rolling to form a male-thread portion which corresponds to the screw shaft portion of the metallic shell.

5. The method as claimed in claim 3, further comprising after the fifth intermediate article preparing step, a step of subjecting a large diameter portion of the fifth intermediate article to machining to form a grooved portion corresponding to a grooved portion between the stop portion and a tool engagement portion of the metallic shell which is engageable with a tool.

6. The method as claimed in claim 1, wherein the metal blank has a locally recessed portion on an outer circumferential surface thereof.

7. The method as claimed in claim 1, wherein the metal blank is made of a low carbon steel.

* * * * *